US006073790A

United States Patent [19]

Umiker

[11] Patent Number: 6,073,790

[45] **Date of Patent: *Jun. 13, 2000**

[54] FOLDING CONTAINER WITH RELEASABLY LOCKING SIDE WALLS

[75] Inventor: Hans Umiker, Egg/ZH, Switzerland

[73] Assignee: Schoeller-Plast S.A., Switzerland

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/945,004

[22] PCT Filed: Feb. 7, 1997

[86] PCT No.: PCT/EP97/00566

§ 371 Date: Feb. 5, 1998

§ 102(e) Date: Feb. 5, 1998

[87] PCT Pub. No.: WO97/29964

PCT Pub. Date: Aug. 21, 1997

[30] Foreign Application Priority Data

Feb. 12, 1996 [DE] Germany ..... 196 05 080

[51] Int. Cl.[7] ..... B65D 6/12

[52] U.S. Cl. ..... 220/6; 220/7; 220/315; 220/913

[58] Field of Search ..... 220/6, 315, 255, 220/334, 337, 338, 340, 342, 346, 375, 7, DIG. 12, DIG. 14, DIG. 15, 675, 676, 913, 374; 217/15, 47; 292/87, 80

[56] References Cited

U.S. PATENT DOCUMENTS

| | | | |
|---|---|---|---|
| 4,542,924 | 9/1985 | Brown et al. | 292/87 |
| 4,674,647 | 6/1987 | Gyenge et al. | 220/6 |
| 4,775,068 | 10/1988 | Reiland et al. | 220/6 |
| 5,158,329 | 10/1992 | Schlack | 292/87 |

*Primary Examiner*—Gregory M. Vidovich
*Assistant Examiner*—Maerena W. Brevard
*Attorney, Agent, or Firm*—Price, Heneveld, Cooper, DeWitt & Litton

[57] ABSTRACT

In a plastic transport container having inwardly folding side walls the side walls are mutually fixed in the erect position by snap-in elements which can be released by mere finger pressure. This finger pressure for releasing the snap-in elements at the same time causes the side walls to fold inward.

12 Claims, 7 Drawing Sheets

F-F 2:1

G-G 2:1

H-H 2:1

J-J 2:1

K-K 2:1

L-L 2:1

FOLDING CONTAINER WITH RELEASABLY LOCKING SIDE WALLS

Figure 1:
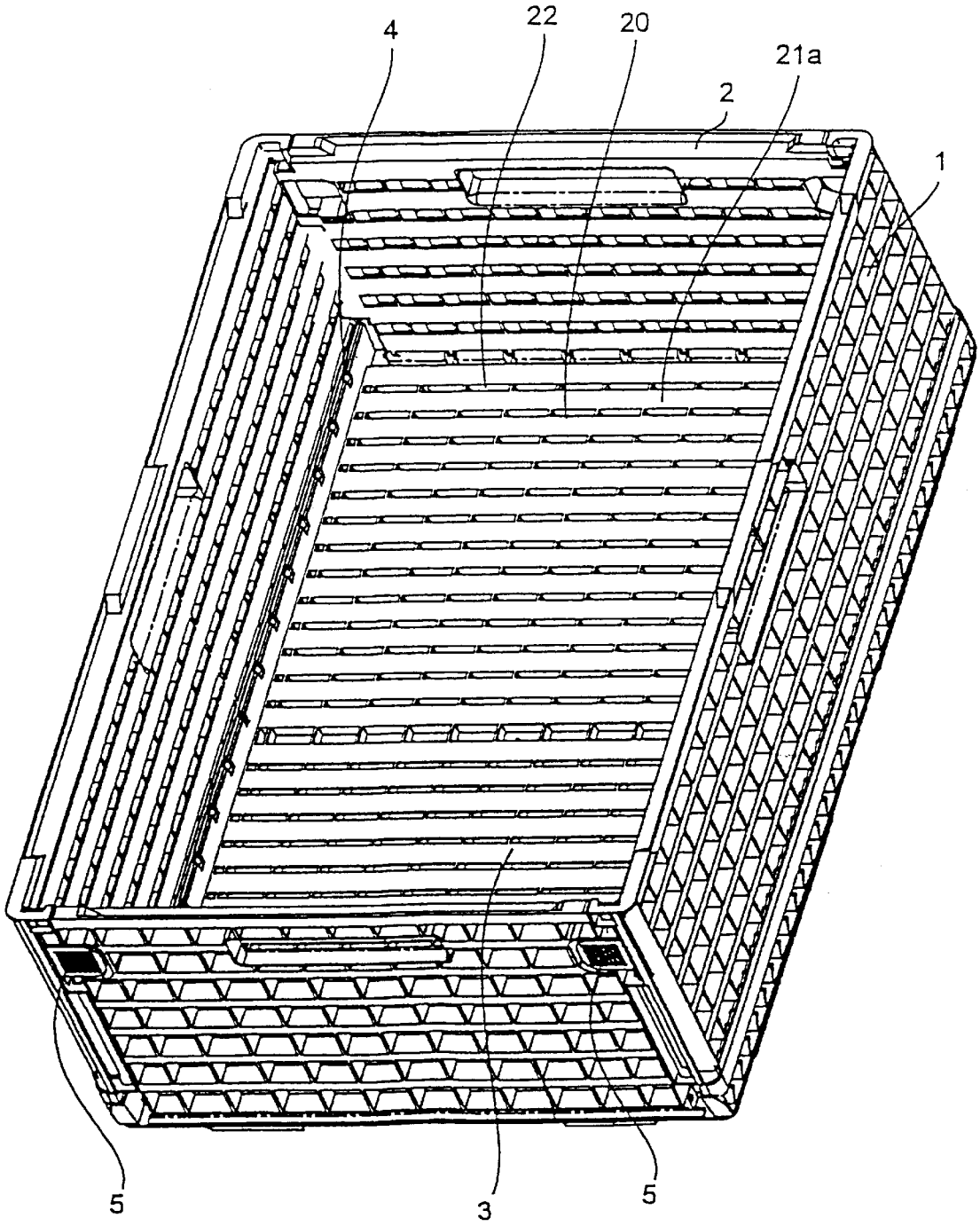

This application is the National Stage of International Application No. PCT/EP97/00566, filed Feb. 7, 1997, which claims the benefit of German Application No. 19605080.4, filed Feb. 12, 1996.

This invention relates to folding containers for fruit and vegetables for example, in particular folding containers whose walls fold inward onto the container bottom and are interconnected by snap-in elements in the erect position. Such a folding container is indicated by the features of the preamble of claim 1.

For transporting goods of daily life, in particular perishable foods such as fruit, lettuce and the like, it is a well-known procedure to use containers whose side walls can be folded up over the bottom. This on one hand provides sufficient volume for transport, while on the other hand the containers take up accordingly little space during empty transport, i.e. return transport. A great variety of suggestions have been made on how to design a suitable transport container for the abovementioned purposes.

An ever recurring discrepancy in the transport of perishable goods in containers is the relationship between the lightness of the container, which is generally obtained by a perforated bottom and side wall structure, and protection of the contained goods from damage. The main danger here is that the contained goods, e.g. bananas or the like, can be damaged from outside since e.g. in a mixed stack with wooden containers or wooden crates splinters can penetrate through the open structure of the side and bottom walls and pass into the transported goods, making them unfit for sale.

A further problem of known containers is that it is frequently very difficult to handle the connecting mechanisms for the erect side walls of such containers. This is a very great problem because these folding containers are predominantly operated by untrained personnel, being in particular also used in the private sphere. It is often very difficult to release the side walls from their lock-in position because the actual snap-in mechanism is unknown and no operating instructions are generally provided for such containers. The users of the folding containers therefore hurt themselves particularly when converting the container to the service position or the empty position since they scrape their hands or pinch their fingers. This problem is not to be underestimated because the acceptance of such folding containers depends upon the attitude of users on the market. It is therefore very essential that folding containers, while having a very stable snap-in connection, permit very simple unlocking and conversion of the side walls to the empty position, i.e. the return transport position.

The problem of the invention is to provide a folding container whose folding walls can be easily fixed in the erect position but also very simply released and converted to the return transport position in which the side walls are folded onto the bottom. Further, damage-free transport of the contained goods should be ensured.

This problem is solved according to the invention by the features contained in the characterizing part of claim 1, expedient developments of the invention being characterized by the features contained in the subclaims.

According to the invention the snap-in locking is effected by snap-in elements which can be released with simple finger pressure, the side walls being converted to the folded position, i.e. folded onto the container bottom, with the same finger pressure operation at the same time as the snap-in elements are released. For this purpose the snap-in elements are equipped with a pressure lever which is preferably adapted to a finger surface, in particular the thumb surface, and is thus immediately recognized optically by the user as a pressure lever and as the actual operating surface for releasing the snap-in element. That is to say, the user will automatically press the lever, thereby simultaneously causing the side walls to fold into each other and consequently ensuring very simple handling of the container. Mere pressure on the lever causes the snap-in element to swivel slightly so that the snap-in part, preferably designed in the form of a snap-in nose, is moved or swiveled away from the opposite snap-in part, e.g. a snap-in projection. Further finger pressure then causes the side wall to be folded inward past this snap-in projection.

For this purpose it is expedient if the snap-in elements and thus also the pressure levers are provided in the upper area and on the side edges of the first side walls to be folded inward.

It is expedient to give the pressure lever an elongate design and dispose it on one side of the link point of the snap-in element on the side wall, the snap-in part formed as a snap-in nose being located opposite the lever. This results in very good leverage. Further, the snap-in part is disposed on the outside with respect to the snap-in projection.

The link point of the snap-in element on the side wall is expediently approximately flush with the inside surface of the side wall, the pressure lever being shifted outward at a distance so as to ensure space for pressing the lever inward. The lever is preferably located at a distance of 10 to 15 mm from the inside surface of the side wall, but the lever is preferably still received within the outside contour of the side wall, it being expedient to have the outside surface of the lever extend flush with the outside surface of the side wall. This rules out all danger of injury and also the interlocking of the containers with other objects. At the same time this arrangement protects the lever and snap-in element from damage. If required, the snap-in element can also be formed as a separate component so that it can be replaced in case of damage.

Figure 2:
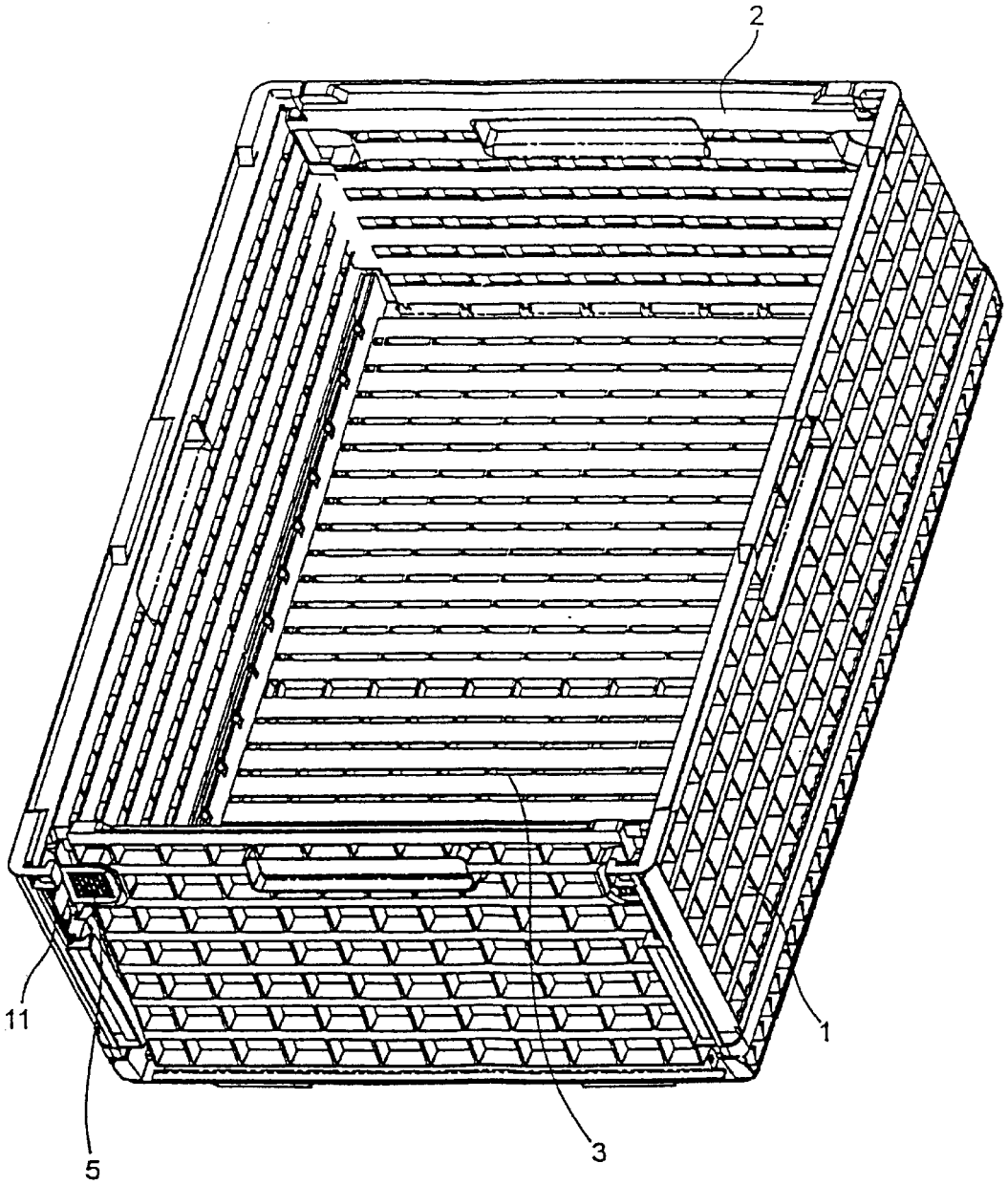
Figure 3:
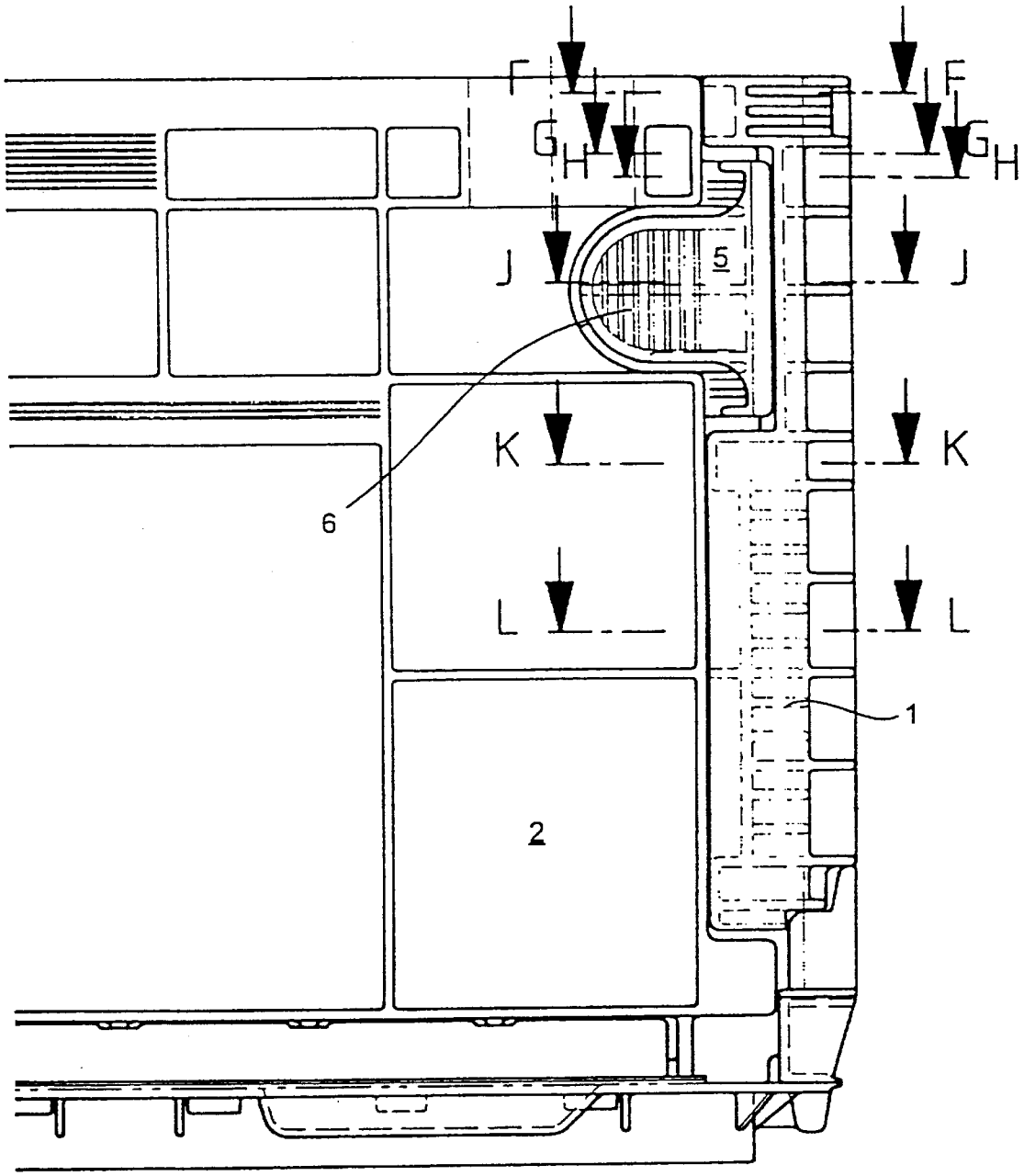
Figure 4:
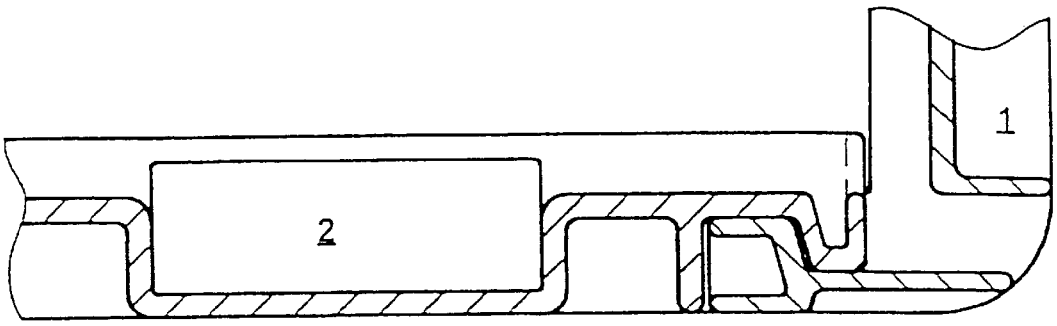
Figure 11:
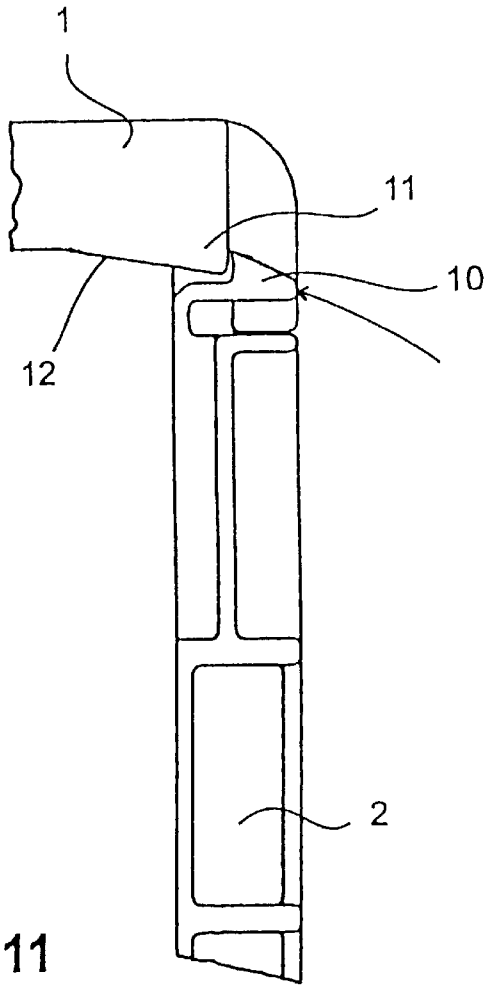
Figure 10:
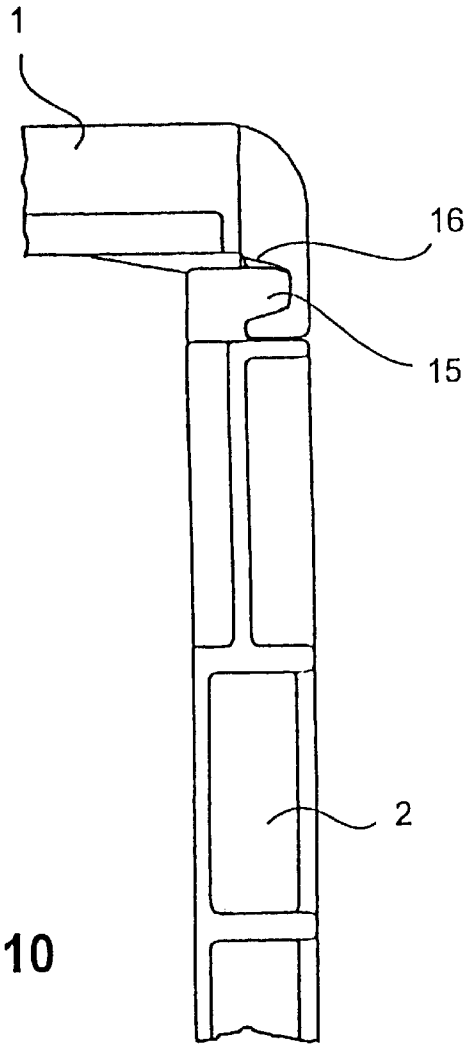
Figure 12:
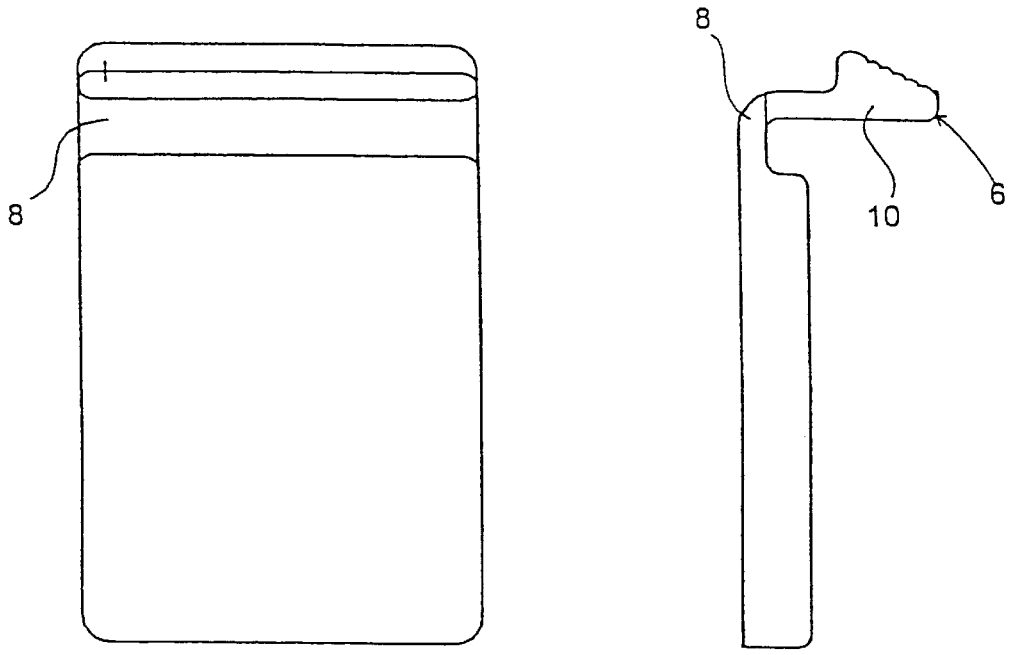
Figure 13:
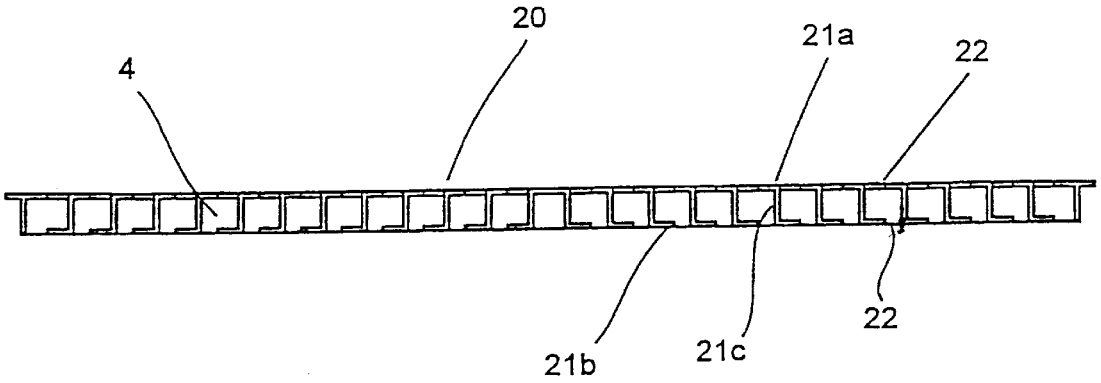

In the following a preferred embodiment of the invention will be described with reference to the drawing, in which:

FIG. 1 shows a perspective view of a plastic folding container in the service position, i.e. with side walls erected vertically from the container bottom, FIG. 2 shows a perspective view of the folding container shown in FIG. 1 at the onset of conversion of the container to the return transport position in which the side walls are folded onto the container bottom, FIG. 3 shows a partial view of the narrow side wall of a folding container in the basic structure according to FIGS. 1 and 2, whereby for simplicity's sake only the right half of the narrow side wall is shown, in an outside view, FIGS. 4 to 9 show partial sections according to the sectional lines of FIG. 3, FIG. 10 shows a view of the connecting area of a narrow and a long side wall in a schematic representation, FIG. 11 shows a connecting area according to FIG. 10 but showing a section at the level of the snap-in element, FIG. 12 shows the snap-in element for connecting the long and narrow side walls in the erect position, and FIG. 13 a partial section through a side wall of the container, likewise in a schematic representation, to show the opening areas of the side wall, and FIG. 13 shows a sectional view through the container bottom.

The folding container shown in FIG. 1 serves chiefly for transporting fruit and vegetables and is therefore formed with openings in the side walls and container bottom. The openings are designed in such a way that the side walls cannot be pierced from outside and the transported goods thereby damaged. Nevertheless sufficient ventilation from outside is ensured. The design of these side walls is optional; in case the folding container is intended for transporting other goods one can also use closed side wall formations or partly open side wall formations.

According to the representation in FIG. 1 the folding container has two opposite long side walls 1 and two opposite narrow side walls 2 which, in the service position shown, are folded upon in the vertical position with respect to container bottom 3. In this position side walls 1 and 2 are locked together, which is effected by snap-in elements to be described more closely in the following. Side walls 1 and 2 are connected with container bottom 3 via strap hinges 4. When the folding container is converted to the return transport position in which the four side walls are folded onto the bottom, narrow side walls 2 are first folded onto the bottom according to the shown embodiment and long side walls 1 then folded onto side walls 2 already folded onto the bottom. In other embodiments the long side walls can of course be folded in first and the narrow side walls then folded onto the long side walls already folded in.

In the shown embodiment, side walls 1 and 2 folded open in the vertical position are unlocked in very simple fashion by finger pressure on pressure levers 5 apparent from FIG. 2 which are immediately recognized by the user of the folding container as the corresponding release elements due to their arrangement and formation as finger pressure surfaces. Mere finger pressure on levers 5 expediently provided with knobs or furrows or longitudinal grooves on the outside surface causes the snap-in elements described more closely in the following to be unlocked and opposite narrow side walls 2 to be simultaneously folded onto container bottom 3. This is thus effected with one finger pressure motion without additional handling operations, practically automatically upon corresponding purposeful operation of pressure levers 5. Pressure levers 5 are disposed on the narrow sidewalls in the area of the two side edges at the top.

FIG. 3 indicates more clearly the snap-in element with pressure lever 5 in an enlarged representation, the structure and coordination of the snap-in elements and the connecting area of the narrow and long side walls altogether being indicated in detail by FIGS. 4 to 9.

Figure 5:
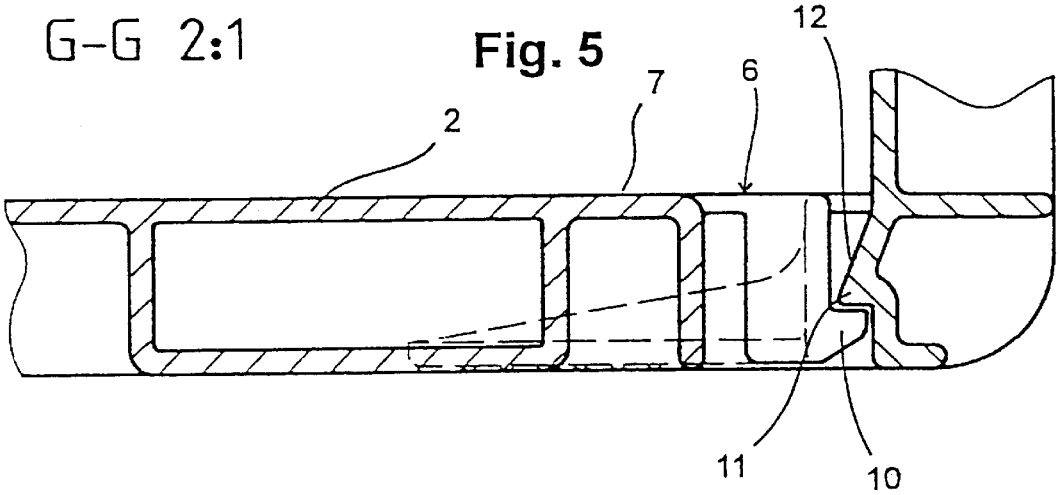
Figure 6:
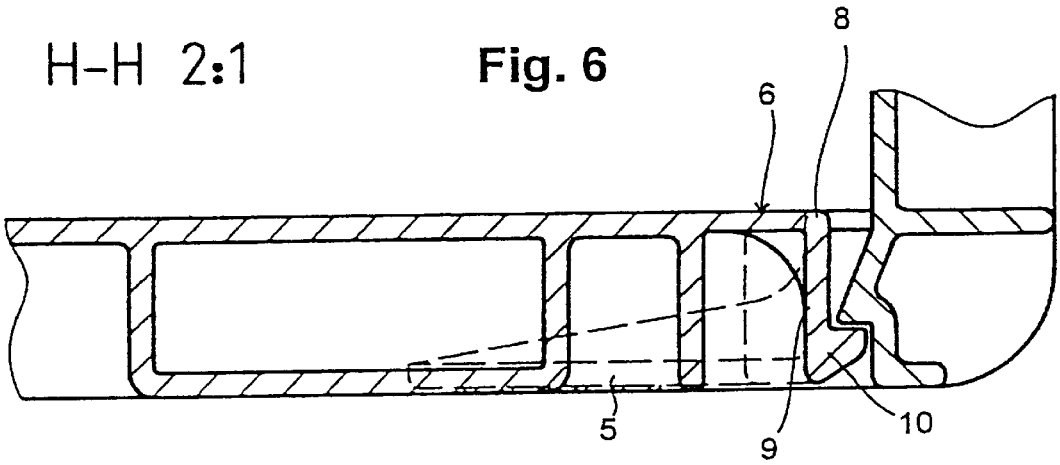
Figure 7:
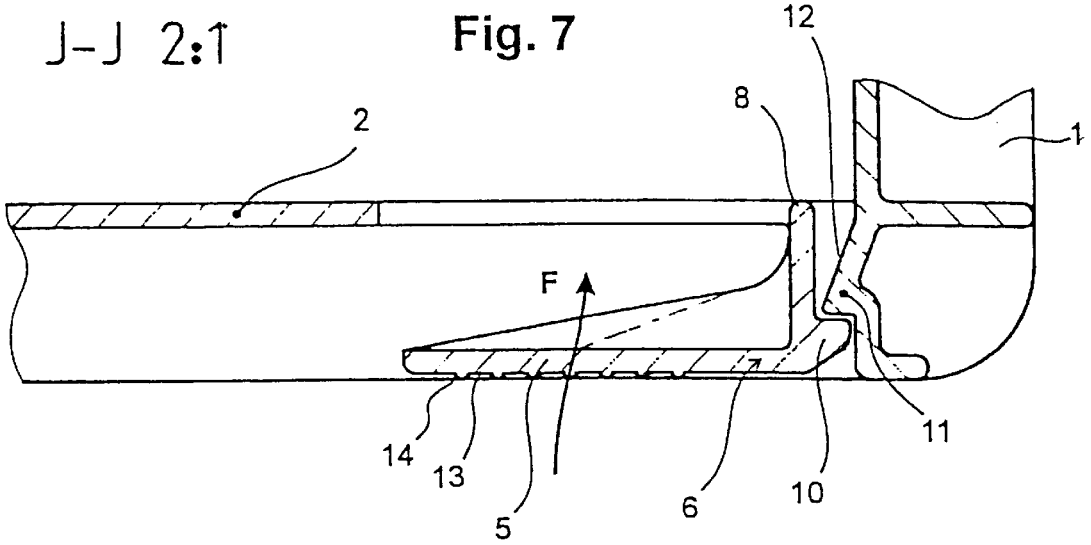
Figure 8:
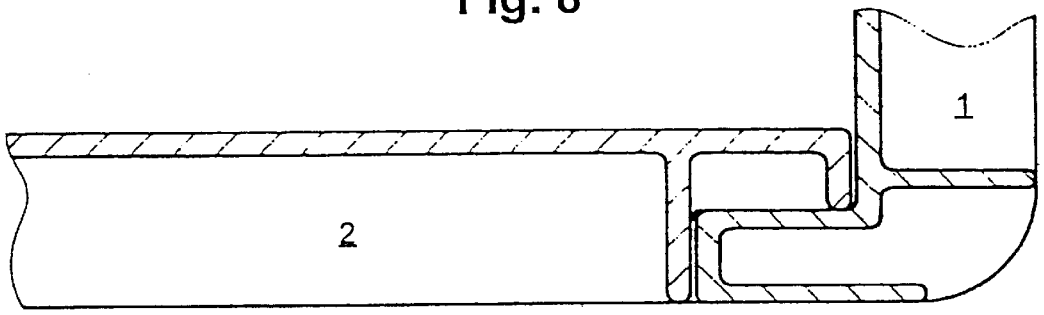
Figure 9:
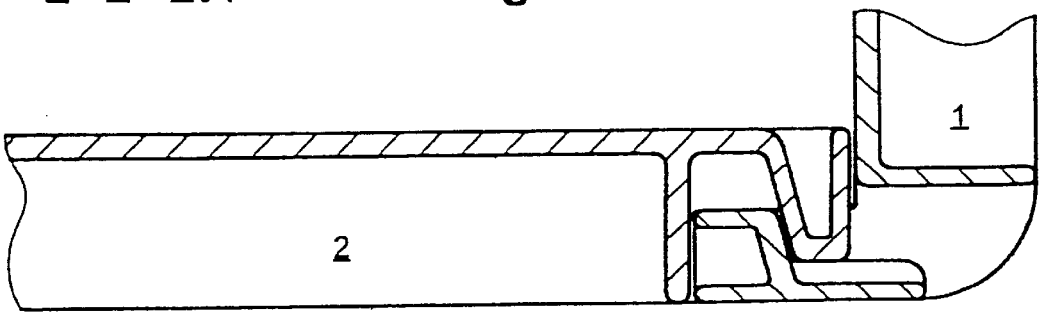

In particular FIGS. 5, 6 and 7 indicate specifically snap-in element 6 used for snap-in locking of the long and narrow side walls, which is formed integrally with corresponding narrow side wall 2 in the shown embodiment. Alternatively the snap-in element can also be formed as a separate component, which in particular permits removal and replacement of a damaged snap-in element. This embodiment is also optional.

As indicated best by FIGS. 5 and 6, snap-in element 6 is integrally connected with narrow side wall 2 in the area of the inside surface of said wall and extends in this area flush with inside surface 7 of narrow side wall 2. The connecting area is illustrated as 8 in FIG. 6. Link area 8 serves as a joint for the snap-in element, as to be described in the following. From link area 8 cross bar 9 extends outward having disposed on its end both pressure lever 5 and snap-in part 10 formed as a snap-in nose. Snap-in nose 10 protrudes from cross bar 9 toward long side wall 1 while lever 5 extends in the opposite direction. As indicated by FIGS. 5 to 7, in the lock-in position snap-in element 6 engages behind snap-in projection 11 on the long side wall protruding toward narrow side wall 6. Snap-in projection 11 has run-on ramp 12 over which snap-in part 10 moves when narrow side wall 2 is folded open. When run-on ramp 12 has been covered the snap-in element springing around hinge point 8 snaps behind snap-in projection 11 so as to ensure snap-in locking of side walls 1 and 2.

Pressure lever 5 has sufficient length to permit light operation of the finger in the direction of arrow F to cause snap-in nose 10 to swivel away due to the swivel of cross bar 9 around hinge point 8. As soon as snap-in part 10 is swiveled away from snap-in projection 11 by corresponding operation of lever 5, the further finger pressure operation causes narrow side wall 2 to fold inward toward bottom 3 past erect long side wall 1. Narrow side wall 2 thus folds automatically upon operation of lever 5 at corresponding finger pressure. Obviously, the length of the lever is dimensioned firstly so that the snap-in element is released upon corresponding leverage and the side wall can secondly be easily folded inward onto the container bottom with this finger pressure. The length of lever 5 is in particular adapted to average thumb size. Since the snap-in parts can be released simply by light finger pressure with the described formation and arrangement of the lever, the elements responsible for the snap-in locking can be very rigid and strong, which is important for robustness and service life. FIG. 7 further indicates a suitable profiling of the pressure surface of lever 5, here resulting from parallel gaps 13 forming furrows or ribs 14 protruding therebetween. The design of the snap-in element can be seen quite clearly from the section in FIGS. 5 to 7 so that further descriptions are unnecessary. The design of the connecting area between the narrow side walls and long side walls is also indicated by the sectional views in FIGS. 4, 8 and 9 which show the engagement and stop between the walls. One can see that a very stable hold of side walls 1 and 2 is ensured in the lock-in position.

Finally FIG. 3 shows quite clearly that pressure lever 5 adapted approximately to a thumb pressure surface widens in the area of the snap-in part so as to ensure a sufficient snap-in surface, the snap-in noses extending on both sides. Due to the central arrangement of lever 5 no tilting is possible and one thus achieves or ensures an immediate snap-in connection and simple release of the snap-in locking. Also, lever 5 does not protrude outward from the remaining outside surface of narrow side wall 2 but is received in a corresponding recess flush within the narrow side wall. A further advantage is that due to cross bar 9 lever 5 is located at a distance from actual link point 8, which permits simple and user-friendly operation of the snap-in elements. One can see that the force exerted on the lever by the finger for releasing the snap-in elements acts in the direction of the fold-in motion of the side walls.

FIGS. 10 and 11 show the particular ends of the long and narrow side walls in two different sections in a slightly modified embodiment. FIG. 10 makes clear how suitable projections or noses 15 in narrow side wall 2 engage corresponding recesses 15 in the long side wall. When noses 15 are in position within recesses 16, the narrow and long side walls assume a defined position relative to each other in the erect position, which is useful both for easily changing the transport container for transport in the storage position and for the stability of the transport container in the transport position with erect side walls.

FIG. 11 shows snap-in element 6 which again has snap-in nose 10 grasping behind corresponding snap-in projection 11 on long side wall 1 in the snap-in position. FIG. 12 shows snap-in element 6 in detail, a closer description being unnecessary due to the representation. As one can see, snap-in nose 10 is spring-mounted due to link point 8 so that snap-in locking can be released by finger pressure. In FIG. 11 number 12 again designates a slanting surface used for the spring deflection of the snap-in element during erection of the narrow side wall. The spring force can be adjusted in simple fashion during production by for example suitable selection of the thicknesses of the bar areas, in particular the area in the area of link point 8. As one can see, the snap-in element ensures that the connection of the long and narrow side walls in the erect state can be released by mere pressure on the pressure surface of the lever without any danger of injury and without any need for complicated mechanisms to be activated. Mere finger pressure on the pressure surface of the snap-in element permits the engagement between snap-in nose and snap-in projection to be released and the narrow side wall to be folded inward.

FIG. 1 shows a horizontal projection of the container bottom in an impenetrable formation, whereby the side walls can also be formed accordingly. The upper side of impenetrable bottom or wall formation 20 is formed by profile legs 21*a* disposed side by side at a small distance and forming a smooth outside surface which is easy to clean and conveys an esthetic, quiet external appearance. Through spaces 22 of adjacent profile legs 21*a* one can see profile legs 21*b* disposed on the underside of the bottom formation in FIG. 13, which shows a section through the bottom formation according to FIG. 1. Profile legs 21*b* are disposed precisely in the area of spaces 22, thereby preventing a look through and the penetration of objects through the wall formation. Spaces 22 are separated by cross bars which are apparent from FIG. 1. These cross bars interconnect profile legs 21*a* and 21*b* in the direction of the longitudinal extension of the wall formation. The number of these cross strips is obviously strictly optional. FIG. 13 again shows profile legs 21*a* and 21*b* which define the upper and lower superficial extension of the bottom formation and wall formation, two corresponding profile legs of the upper side and underside being interconnected by bar 21*c*. Legs 21*a* and 21*b* and bar 21*c* connecting them thus result in a profile which is shaped in this embodiment as a Z but can also have an I, T or S shape. As apparent from FIG. 13, the profiles disposed side by side at a small distance result in a structure which admits the passage of ventilation air but no penetration of objects.

What is claimed is:

1. A folding container made of plastic having inwardly folding side walls (1, 2) fixed relative to each other by snap-in locking in the erect position, two opposite side walls (2) first being folded inward onto the container bottom between the other pair of side walls still standing and this other pair of opposite side walls then being folded in, characterized in that snap-in elements (6) to be released by mere finger pressure are provided for the snap-in locking on the first side walls (2) to be folded inward, said elements engaging in the snap-in position behind corresponding snap-in projections (11) from the other side walls (1) and being substantially flush with first side walls (2) and disposed or formed in such a way that upon release of the snap-in elements (6) by finger pressure the first side walls (2) to be folded inward are folded inward at the same time and further wherein at least a portion of one of the walls has offset profile legs forming the surfaces of the wall and the legs being interconnected by longitudinal bars in such a manner to permit the flow of air therethrough while rendering the wall substantially impenetrable.

2. The container of claim 1, characterized in that the snap-in elements (6) are provided in the upper area and on the side edges of the first side walls (2) to be folded inward.

3. The container of claim 1, characterized in that the snap-in elements (6) each have a pressure lever (5) jointed on the corresponding side wall (2) such that pressure on the lever (5) causes the snap-in element (6) to move or swivel away from the corresponding snap-in projection (11) and the side wall to fold in.

4. The container of claim 1, characterized in that the pressure lever (5) is of elongate design and disposed on one side of the joint (8) of the pressure lever, and the snap-in part (10) of the snap-in element (6) is located on the other side of the joint (8).

5. The container of claim 1, characterized in that in the snap-in position the snap-in part (10) of the snap-in element (6) is located outside the snap-in projection (11) with respect to the interior of the container.

6. The container of claim 1, characterized in that the pressure lever (5) and the snap-in part (10) of the snap-in element (6) are shifted outward with respect to the joint (8) disposed on the inside surface of the side wall (2), and are disposed on a bar (9) protruding outward from the joint (8).

7. The container of claim 1, characterized in that the pressure lever is shifted 10 to 15 mm outward with respect to the inside surface of the side wall.

8. A folding container comprising:

a bottom defining a plurality of edges about a periphery thereof;

a first pair of opposed sides hingedly attached to a first opposed pair of said edges and movable between a collapsed position substantially parallel with said bottom and an erect position, said hinges positioned such that each of said first opposed sides lie flat against a top surface of said bottom when collapsed;

a second pair of opposed sides hingedly attached to a second opposed pair of said edges and movable between a collapsed position substantially parallel with said bottom and an erect position, said hinges positioned such that each of said second opposed sides lie flat against an exposed surface of said first opposed sides when said first opposed sides are collapsed and when erect in combination with said first pair of opposed sides and said bottom defining a cavity for holding articles therein; and at least two snap-in locks on each of said first opposed sides and flush with an outer surface of said first opposed sides wherein said snap-in locks engage a portion of each of said second opposed sides, such that said locks self engage to said second opposed sides when said first and second opposed sides are raised to their erected position and further wherein a force applied to said snap-in locks on a first of said first opposed sides disengage said locks from said second opposed sides and simultaneously therewith causes said first of said first opposed sides to collapse upon said bottom.

9. The collapsible container of claim 8 wherein each of said snap-in locks are positioned along an upper half of said first opposed sides.

10. The collapsible container of claim 8 wherein:

side edges of each of said first opposed sides include a first finger pointing outwardly from said container and define a first channel in combination with said first side;

side edges of said second opposed sides include a second finger pointing inwardly toward an interior of said container and define a second channel in combination with said second side; and each of said first fingers is received by a second channel and each of said second fingers is received by a first channel when said first and second sides are engaged one with the other.

11. The collapsible container of claim 8 wherein each said snap-in lock comprises:

a pressure lever substantially flush with and parallel to an outer surface of one of said first opposed sides;

a snap-in element at an outer end of said pressure lever;

a resilient joint, joining said pressure lever to said first opposed side; and a snap-in projection on said outer side edge of said second opposed side and engaged with said a corresponding snap-in element when said first opposed sides are engaged with said second opposed sides.

12. The collapsible container of claim 11 wherein said resilient joint is positioned intermediately to said pressure lever and said snap-in element, such that pressure on said pressure lever causes said snap-in projection to disengage from said snap-in projection.

* * * * *

UNITED STATES PATENT AND TRADEMARK OFFICE

CERTIFICATE OF CORRECTION

PATENT NO. : 6,073,790
DATED : June 13, 2000
INVENTOR(S) : Hans Umiker

It is certified that error appears in the above-identified patent and that said Letters Patent is hereby corrected as shown below:

Column 8, claim 11,
Line 2, delete "a".

Signed and Sealed this

Eighteenth Day of September, 2001

*Attest:*

Nicholas P. Godici

NICHOLAS P. GODICI
*Acting Director of the United States Patent and Trademark Office*

*Attesting Officer*